US008201809B2

(12) United States Patent
Bolton

(10) Patent No.: US 8,201,809 B2
(45) Date of Patent: Jun. 19, 2012

(54) LIFT FOR SERVICING AIRCRAFT

(76) Inventor: William Bolton, Lakeland, TN (US)

( * ) Notice: Subject to any disclaimer, the term of this patent is extended or adjusted under 35 U.S.C. 154(b) by 363 days.

(21) Appl. No.: 12/563,155

(22) Filed: Sep. 20, 2009

(65) Prior Publication Data

US 2010/0072442 A1 Mar. 25, 2010

Related U.S. Application Data

(60) Provisional application No. 61/098,761, filed on Sep. 20, 2008.

(51) Int. Cl.
*B66D 1/36* (2006.01)

(52) U.S. Cl. ..... 254/325; 254/334; 254/4 R; 254/4 B; 254/2 R; 414/490

(58) Field of Classification Search ..... 254/323, 254/324, 325, 334, 4 R, 4 B, 2 R, 127, 128; 414/444, 490
See application file for complete search history.

(56) References Cited

U.S. PATENT DOCUMENTS 2,267,355 A * 12/1941 Riper ..... 414/420
2,465,796 A 3/1949 Freeman
2,847,243 A 8/1958 Hare
3,578,353 A * 5/1971 Lockhart ..... 280/47.2
3,623,620 A 11/1971 Vermette
5,017,080 A * 5/1991 Thorndike et al. ..... 414/454
5,251,922 A * 10/1993 Mann ..... 280/47.29
5,975,826 A * 11/1999 Scholder ..... 414/444
6,309,168 B1 * 10/2001 Holmes ..... 414/490
6,371,449 B1 * 4/2002 Chamberlain ..... 254/387
6,390,450 B1 5/2002 Bressner et al.
6,601,825 B2 8/2003 Bressner et al.
6,921,095 B2 * 7/2005 Middleby ..... 280/47.29
7,311,297 B1 * 12/2007 Bradshaw et al. ..... 254/272

OTHER PUBLICATIONS

Tronair, Inc., "Operation & Service Manual—Learjet Battery Lift—Model: 04-6000-910," Jul. 2009, Tronair, Inc. 1740 Eber Road, Holland, Ohio 43528-9794, U.S.A.
Tronair, Inc., "Operation & Service Manual—Model: 04-6014-0010—Bae HS-125 Battery Lift," Jan. 2007, Tronair, Inc. 1740 Eber Road, Holland, Ohio 43528-9794, U.S.A.
Tronair, Inc., "Operation & Service Manual—Model: 04-6028-0121—Universal Lift ," Mar. 2004, Tronair, Inc. 1740 Eber Road, Holland, Ohio 43528-9794, U.S.A.
Tronair, Inc., "Operation & Service Manual—Model: 04-6032-0100—ERJ-145 Battery Lift ," Jun. 2003, Tronair, Inc. 1740 Eber Road, Holland, Ohio 43528-9794, U.S.A.

* cited by examiner

*Primary Examiner* — Emmanuel M Marcelo
(74) *Attorney, Agent, or Firm* — Kenneth E. Barnes; Crone & McEvoy, PLC

(57) ABSTRACT

A compact, easily maneuverable lift that may be readily positioned and operated by one person, that is quickly and accurately adjustable to the desired height, and that is particularly applicable to servicing heavy parts such as aircraft batteries. The lift is easy to manufacture and may include a load platform configured to fit into tight spaces. Other embodiments are disclosed.

20 Claims, 3 Drawing Sheets

LIFT FOR SERVICING AIRCRAFT

CROSS REFERENCE TO RELATED APPLICATIONS

This application claims the benefit of U.S. Provisional Patent Application Ser. No. 61/098,761, filed Sep. 20, 2008 by the present inventor.

FEDERALLY SPONSORED RESEARCH

Not Applicable

SEQUENCE LISTING OR PROGRAM

Not Applicable

BACKGROUND OF THE INVENTION

Removing and replacing aircraft batteries is an important part of regular maintenance of modern business jets, and these batteries are heavy and often located in areas of the aircraft that are difficult to easily access, sometimes requiring aircraft mechanics to attempt to hold the 90 lb. batteries at antis length above their heads, risking injury to themselves, and damage to the battery and/or the aircraft.

Servicing the two main batteries in the Bombardier Lear 60 is illustrative of the problem. Behind the access door at the tail of the aircraft is the auxiliary power unit (APU), which must first be removed to access the two batteries, which are located above and behind the APU. The battery closest to the access door is provided with a stirrup-operated cable lift, consisting of a platform on vertical rails that is connected to a cable and pulley system by which the aircraft mechanic can lower the battery into the space formerly occupied by the APU by putting one foot in a loop of cable and slowly raising his leg. After completing that awkward operation, there still remains a second battery located on a fixed shelf behind the first, which is now accessible thanks to the removal of the APU and the first battery creating a path to the access door. Once the first battery has been removed from the cable lift platform, and the cable lift platform itself removed from its vertical rails, the aircraft mechanic is then faced with reaching up to the battery shelf in this cramped space, and removing the second battery without any built-in support to aid in the operation.

Not only must these batteries be removed on a regular schedule as part of routine maintenance of the aircraft, either at six or twelve month intervals depending upon the battery type, but because of their location at the access door of the Lear 60, the APU and the batteries must be removed first before servicing almost any other systems in the tail section of the aircraft. An external lift suitable for supporting and removing aircraft batteries would therefore be desirable.

The need for lifts for servicing aircraft batteries has been recognized for a long time. U.S. Pat. No. 2,465,796 to Freeman (1949) shows a lift with a load support that could be raised and lowered on a continuous loop of chain, and which featured a tilting boom to bring the battery close to the aircraft fuselage. Given the scale of the Freeman lift relative to the battery depicted, and advances in battery technology that have occurred since that time to reduce the weight and size of batteries, the Freeman lift must have been rather large. The Freeman lift's use of a tilting boom to bring the battery into proximity with the location where it is to be installed in the aircraft, especially when there appears to be no provision for controlling the weight at the end of the boom other than the operator's strength in holding the lever, appears to risk damage to the aircraft, or, given a sufficient battery weight and position of the maneuverable front wheel, toppling of the lift itself on its tripod-like wheeled carriage. Despite its apparent size, the Freeman lift appears to have been operable by one person.

A major vendor of ground support equipment, Tronair, Inc., 1740 Eber Rd., Holland, Ohio 43528, offers a hydraulically operated device they term a "universal lift," for which various adapters are available, including load platforms for supporting aircraft batteries. However, the Tronair lift, which resembles an engine hoist, is bulky, weighing over 260 pounds, and requires a substantial amount of hangar space to store. Due to the 82" overall length of the Tronair lift, and the location of the handles for guiding the lift at the opposite end of the horizontal support arm from the load platform, the operator guiding the lift cannot readily see the position of the load platform relative to the cramped space inside the access door of an aircraft like the Lear 60. The jack handle for pressurizing the hydraulic cylinder which raises the horizontal support arm of the Tronair lift is located at the base of the lift opposite from the load platform, also making it difficult for the operator to readily judge the position of the load platform as vertical adjustments are made. The Tronair lift therefore optimally requires two people to position it, one to guide the lift and operate the hydraulic cylinder, and another to act as "spotter," providing the operator with instructions concerning the position of the load platform.

The Tronair lift is hydraulically operated, and so vertical adjustments of the horizontal support arm are accomplished by pumping the jack handle of the hydraulic cylinder to raise the arm, or opening the release valve of the hydraulic cylinder to lower the arm. Coarse adjustments of the vertical position of the load platform are therefore slow, and precise vertical adjustments must be performed even more carefully, because if the desired height is exceeded, depressurizing the hydraulic cylinder by means of the release valve to the precise degree needed to correct the elevation is difficult.

A further disadvantage of Tronair's prior art "universal lift" is the size of the load platform itself, which is 12" square. In servicing the batteries of the Lear 60, for example, the Tronair "universal lift" load platform is too wide to fit between the rails of the stirrup-operated cable lift, and thus the load platform cannot be raised to the level of the shelf holding the second battery.

It is therefore an object of the present invention to provide a compact, easily maneuverable lift suitable for servicing aircraft, and which is particularly applicable to servicing heavy parts such as batteries. It is a further object of the present invention to provide at least one of the following: a lift that can be readily positioned and operated by one person, a lift that is quickly and accurately adjustable to the desired height, a lift having a load platform that can fit into tight spaces, and a lift that is simple to manufacture.

REFERENCE NUMERALS

Figure 1:
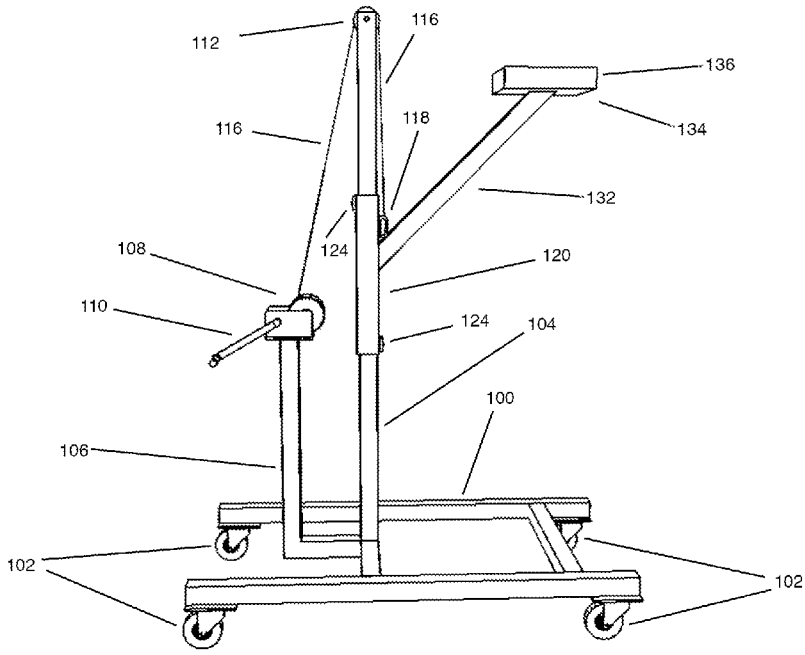
FIG. 1 is an operator's right-side perspective view of a lift constructed in accordance with an embodiment of the invention, showing the load platform in a lowered position.

100. Base member/frame
102. Casters
104. Vertical member
106. Winch support member
108. Winch
110. Winch handle
112. Pulley assembly
114. Channel
116. Cable
118. Cable attachment point
120. Slidable subframe
122. Roller slots
124. Roller
126. Axle
128. Roller mounts
130. Bolts
132. Load support arm
134. Load platform
136. Retaining lip

DETAILED DESCRIPTION OF THE DRAWINGS

The present invention may be embodied in a lift for servicing aircraft. FIG. 1 is an operator's right-side perspective view of a lift constructed according to the present invention. The lift comprises a base member/frame 100, a vertical member 104, a winch support member 106, a winch 108, a slidable subframe 120, a cable attachment point 118; a load support arm 132, a load platform 134, a pulley assembly 112, and a cable 116. The base member/frame 100, vertical member 104, winch support member 106, slidable subframe 120, and load support arm 132 may be made of any suitable rigid material, such as metal, plastic, wood, fiberglass or other composites, preferably metal, and in a preferred embodiment are made from square steel tubing. The load platform 134 may be made of any suitable rigid material, such as metal, plastics, wood, fiberglass or other composites, preferably metal, and in a preferred embodiment is made from sheet steel. The cable 116 may be made from any suitable strong flexible material, such as steel or para-aramid fiber, and in a preferred embodiment is a steel cable.

In a preferred embodiment, square steel tubing comprising the base member/frame 100 is welded together in an H-shape with two crossbars, and the vertical member 104 is welded to the base member frame 100 at the center of the top face of the rear crossbar. In a preferred embodiment, the vertical member 104 comprises square steel tubing, providing flat vertical sides configured to center and align the slidable subframe 120 on the vertical member 104, in co-operation with rollers 124 mounted on the slidable subframe 120.

The base member/frame 100 can be supported on casters 102 to allow easy positioning of the lift, and movement of the lift to and from the work area. In a preferred embodiment, the base member/frame is supported by at least four casters 102, which can include a locking feature, to immobilize the lift in a desired location.

The winch support member 106 is attached to the base member/frame 100, in parallel to the vertical member 104, and in a preferred embodiment, the winch support member 106 is L-shaped, and formed of square steel tubing welded to the center of the rear face of the rear crossbar. This configuration provides an ergonomic toe kick for the operator, allowing the operator to stand close to and slightly forward of the winch support member 106 while positioning the lift and operating the winch 108, providing an improved line-of-sight to observe the position of the load platform 134.

The winch 108 mounted to the winch support member 106 may be powered or manually operated, and in a preferred embodiment is a manually operated brake winch 108, comprising a winch handle 110. In another embodiment of the invention, handles may be attached to the winch support member 106 to assist in positioning and guiding the lift as it is being moved to and from the work area.

Figure 2:
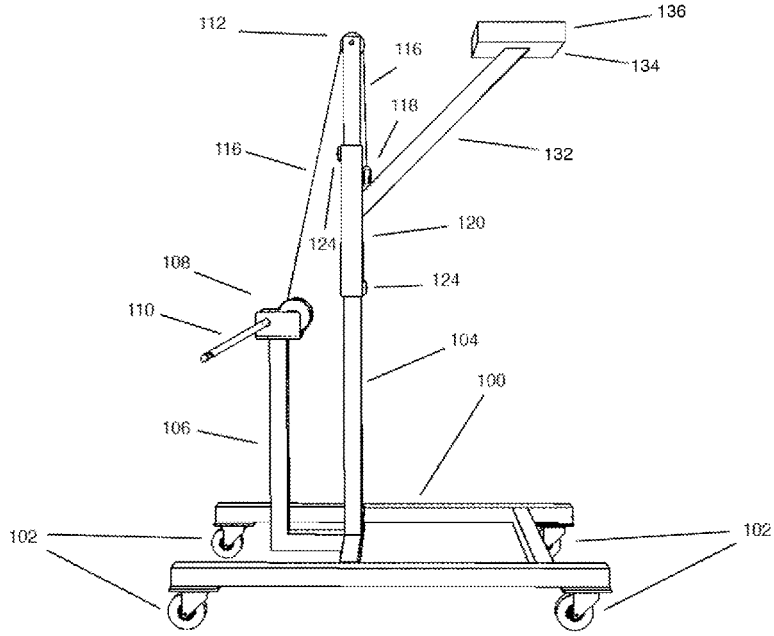
FIG. 2 is an operator's right-side perspective view of a lift constructed in accordance with an embodiment of the invention, showing the load platform in a raised position.

A slidable subframe 120, comprising a cable attachment point 118 encloses the vertical member, and in a preferred embodiment is made of square steel tubing configured to be of a larger size than the square steel tubing comprising the vertical member 104, allowing the slidable subframe 120 to be movable along the vertical member 104. FIGS. 1 & 2 show the slidable subframe 120 in a lowered and raised position, respectively.

Figure 3:
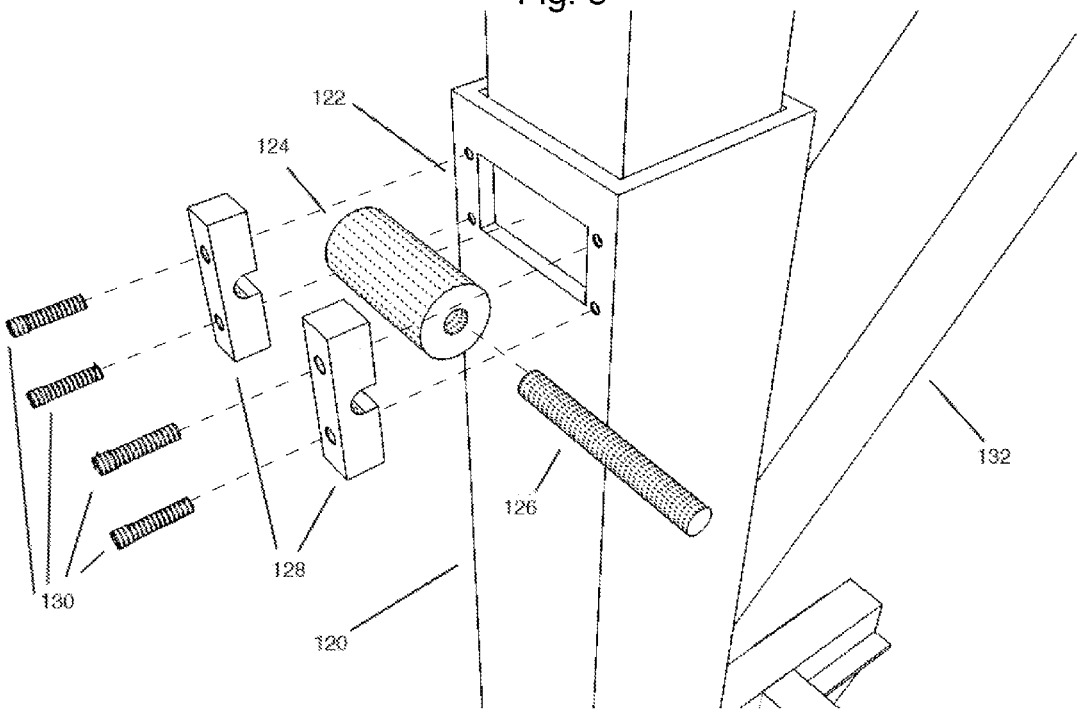
FIG. 3 is an exploded detail view of the upper roller slot, rollers, and roller mounts of a lift constructed in accordance with an embodiment of the invention.
Figure 4:
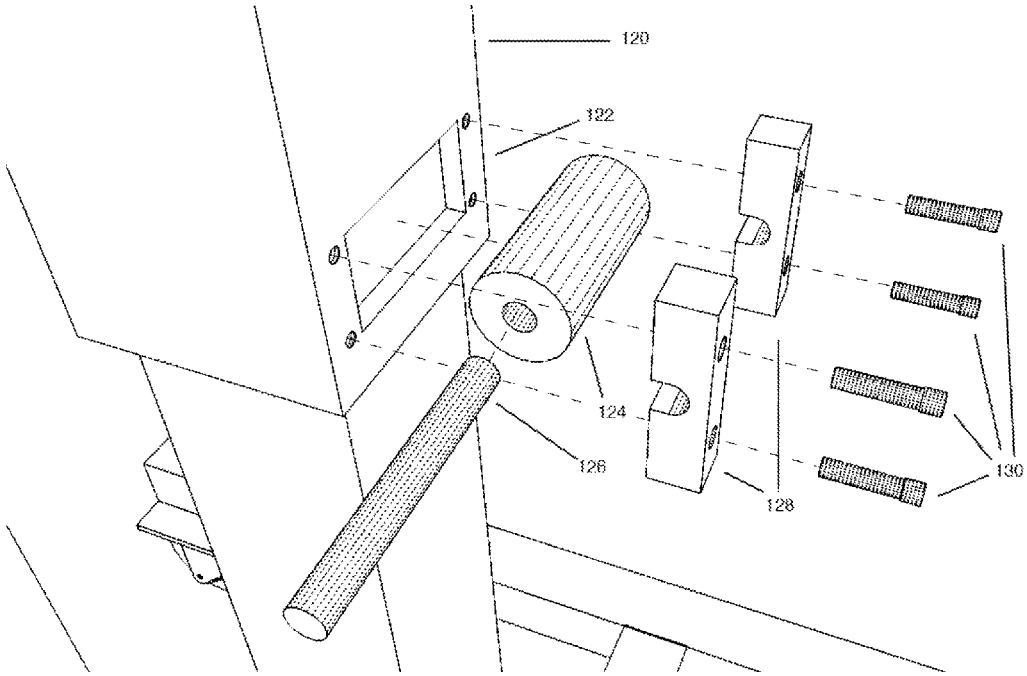
FIG. 4 is an exploded detail view of the lower roller slot, rollers, and roller mounts of a lift constructed in accordance with an embodiment of the invention.

In a preferred embodiment, the slidable subframe 120 further comprises a plurality of rollers 124 to center and guide the slidable subframe along the vertical member 104. The rollers 124 can be made of any suitable firm material such as rubber, plastic, or metal, and in a preferred embodiment are made of plastic. Rollers 124 can be mounted on the slidable subframe 120, and in a preferred embodiment (shown in an exploded detail view in FIGS. 3 and 4), two rollers 124, each comprising an axle 126, are held in place by a pair of roller mounts 128 attached to the surface of the slidable subframe 120, and protrude into roller slots 122 machined into the slidable subframe 120, one at the top rear face of the slidable subframe 120, and one at the bottom front face of the slidable subframe 120, and the rollers 124 are configured to center and guide the slidable subframe 120 along the vertical member 104, in contact and co-operation with the flat vertical sides of the vertical member 104. In a preferred embodiment, the roller mounts 128 are each secured to the slidable subframe 120 by two hex-cap bolts 130.

A load support arm 132 is mounted to and projects from the slidable subframe 120, and in a preferred embodiment the load support arm is made of square steel tubing welded at a 45° upward angle from the center of the front face of the slidable subframe 120.

Figure 6:
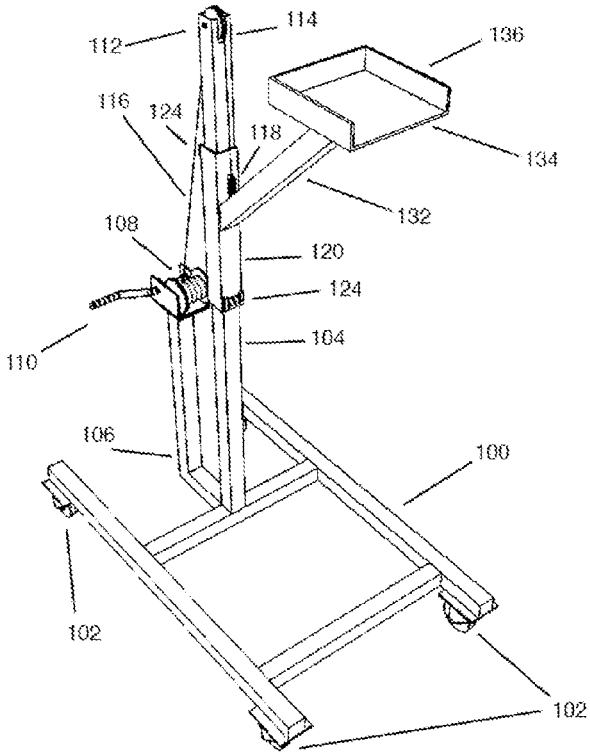
FIG. 6 is a perspective front view of a lift constructed in accordance with an embodiment of the invention, showing the load platform.

A load platform 134 is mounted to the load support arm 132, and configured to be parallel to the base member/frame 100. In a preferred embodiment, shown in FIG. 6., the load platform is made of sheet steel, and is no more than 10 inches square, and further comprises one or more means for preventing shifting of a load, such as a retaining lip 136 or a non-skid pad mounted to the upper surface of the load platform. In another embodiment of the invention, the load platform 134 may be mounted to the load support arm 132 and configured to be rotatable on a vertical ax is, to allow for loading the platform at angles other than from the front of the lift.

Figure 5:
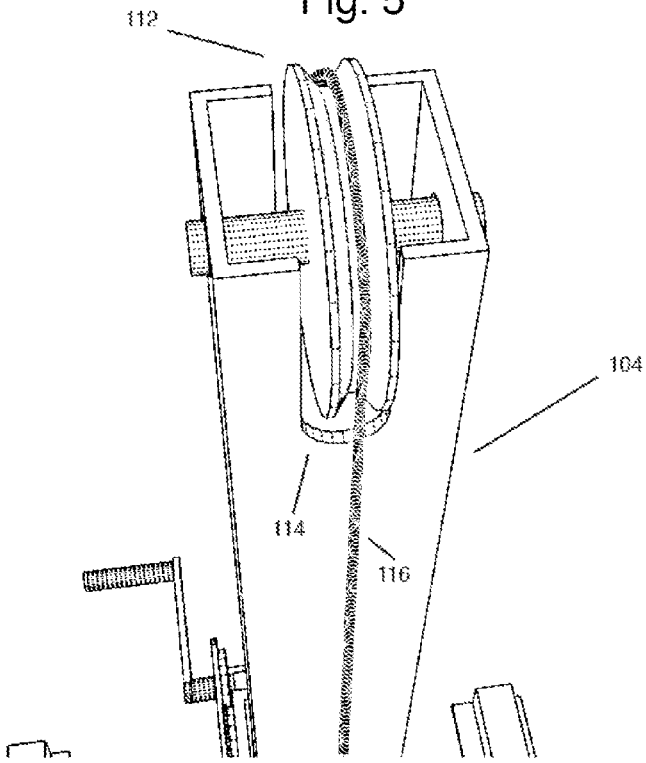
FIG. 5 is a perspective detail view of the pulley assembly and channel of a lift constructed in accordance with an embodiment of the invention.

A pulley assembly 112 is mounted to the end of the vertical member 104 opposite to the base member/frame, and the rotational axis of the pulley assembly 112 is configured to be at right angles to the front face of the vertical member 104. In a preferred embodiment, shown in FIG. 5., the axle of the pulley assembly is mounted in holes machined into the vertical member 104, and the front and rear faces of the top of the vertical member have channels 114 machined into them to guide the cable 116. In another embodiment of the invention, a prefabricated pulley assembly may mounted as a cap to the top end of the vertical member, for ease of manufacture.

A cable 116 is attached by one end to the winch 108 and by the other end to the cable attachment point 118 of the slidable subframe 120, passing over the pulley assembly 112, and configured to raise and lower the slidable subframe 120 along the vertical member 104 by actuation of the winch.

In operation of a preferred embodiment, such as shown in FIGS. 1 & 2, the lift is moved into a desired position on a solid surface by rolling it on the casters 102, then a load such as an aircraft battery is placed on the load platform 134, and the winch 108 is actuated by turning the winch handle 110 in a desired direction, causing the cable 116 to undergo tension, and to be reeled in or out from the winch 108, passing over the pulley assembly 112, and transferring its force to the cable attachment point 118 mounted on the slidable subframe 120, causing the slidable subframe 120 with its attached load support arm 132 and load platform 134 to be raised or lowered along the vertical member 104 according to the direction of rotation of the winch handle 110, and the rollers 124 in contact with the vertical member 104 to center and guide the movement of the slidable subframe 120 along the vertical member 104. When the load is at the desired elevation, the load can then be removed from the load platform 134, and the lift rolled away from the work area on the casters 102.

From the foregoing description it will be apparent that the present invention provides a compact, easily maneuverable lift that may be readily positioned and operated by one person, that is quickly and accurately adjustable: to the desired height, and that is particularly applicable to servicing heavy parts such as aircraft batteries. It will also be appreciated that the lift described above is easy to manufacture and may include a load platform configured to fit into tight spaces.

Although the invention has been shown and described with reference to certain specific presently preferred embodiments, the given embodiments should not be construed as limitations on the scope of the invention, but as illustrative examples, and those skilled in the art to which this invention pertains will undoubtedly find alternative embodiments obvious after reading this disclosure. With this in mind, the following claims are intended to define the scope of protection to be afforded the inventor, and these claims shall be deemed to include equivalent constructions insofar as they do not depart from the spirit and scope of the present invention.

I claim:

1. A lift for servicing aircraft, comprising:

a base member/frame;

a vertical member perpendicularly mounted to said base member/frame;

a winch support member mounted to said base member/frame in parallel to said vertical member;

a winch attached to said winch support member;

a pulley assembly mounted to said vertical member opposite to said base/member frame;

a slidable subframe enclosing and positionable along said vertical member, said slidable subframe comprising a cable attachment point;

a cable having a first end and a second end, the first end secured to said winch, and the second end secured to said cable attachment point, the cable extending over said pulley assembly;

a load support arm mounted to and projecting from said slidable subframe at an upward angle;

a load platform mounted to and supported by said load support arm.

2. The lift as in claim 1, wherein the base member/frame is supported by a plurality of casters.

3. The lift as in claim 1, wherein the vertical member comprises three or more flat vertical sides.

4. The lift as in claim 1, wherein the vertical member further comprises a channel for guiding the cable.

5. The lift as in claim 4, wherein the channel comprises a notch in the vertical member opposite the base member/frame.

6. The lift as in claim 5, wherein the pulley assembly is mounted within the notch in the vertical member opposite the base member/frame.

7. The lift as in claim 1, wherein the winch comprises a brake winch.

8. The lift as in claim 1, wherein the slidable subframe further comprises a means for centering and guiding the slidable subframe along the vertical member.

9. The lift as in claim 8, wherein the means for centering and guiding the slidable subframe comprises a plurality of rollers.

10. The lift as in claim 1, wherein the load platform further comprises a means for preventing shifting of a load.

11. The lift as in claim 10, wherein the means for preventing shifting of a load comprises one or more raised edges of the load platform.

12. The lift as in claim 10, wherein the means for preventing shifting of a load comprises a non-skid material mounted to the load platform.

13. A lift for servicing aircraft, comprising:

a base member/frame;

a plurality of casters mounted to and configured to support said base member/frame;

a vertical member comprising three or more flat vertical sides, said vertical member perpendicularly mounted to said base member/frame;

a winch support member mounted to said base member/frame in parallel to said vertical member;

a winch attached to said winch support member;

a pulley assembly mounted to said vertical member opposite to said base/member frame;

a slidable subframe enclosing and positionable along said vertical member, said slidable subframe comprising a cable attachment point and a plurality of rollers configured to center and guide said slidable subframe along said vertical member;

a cable having a first end and a second end, the first end secured to said winch, and the second end secured to said cable attachment point, the cable extending over said pulley assembly;

a load support arm mounted to and projecting from said slidable subframe at an upward angle;

a load platform mounted to and supported by said load support arm.

14. The lift as in claim 13, wherein the vertical member further comprises a channel for guiding the cable.

15. The lift as in claim 14, wherein the channel comprises a notch in the vertical member opposite the base member/frame.

16. The lift as in claim 15, wherein the pulley assembly is mounted within the notch in the vertical member opposite the base member/frame.

17. The lift as in claim 13, wherein the winch comprises a brake winch.

18. The lift as in claim 13, wherein the load platform further comprises a means for preventing shifting of a load.

19. The lift as in claim 18, wherein the means for preventing shifting of a load comprises a non-skid material mounted to the load platform.

20. The lift as in claim 18, wherein the means for preventing shifting of a load comprises one or more raised edges of the load platform.

* * * * *